US011716579B2

(12) United States Patent
Veneri et al.

(10) Patent No.: US 11,716,579 B2
(45) Date of Patent: Aug. 1, 2023

(54) MICRO-ELECTRO-MECHANICAL ACOUSTIC TRANSDUCER DEVICE WITH IMPROVED DETECTION FEATURES AND CORRESPONDING ELECTRONIC APPARATUS

(71) Applicant: STMICROELECTRONICS S.r.l., Agrate Brianza (IT)

(72) Inventors: Marco Veneri, Milan (IT); Alessandro Morcelli, Milan (IT)

(73) Assignee: STMICROELECTRONICS S.r.l., Agrate Brianza (IT)

( * ) Notice: Subject to any disclaimer, the term of this patent is extended or adjusted under 35 U.S.C. 154(b) by 0 days.

(21) Appl. No.: 17/735,048

(22) Filed: May 2, 2022

(65) Prior Publication Data

US 2022/0337958 A1 Oct. 20, 2022

Related U.S. Application Data

(60) Continuation of application No. 16/902,875, filed on Jun. 16, 2020, now Pat. No. 11,350,222, which is a (Continued)

(30) Foreign Application Priority Data

Nov. 8, 2013 (IT) ..... TO2013A000910

(51) Int. Cl.
*H04R 19/04* (2006.01)
*H04R 23/00* (2006.01)
(Continued)

(52) U.S. Cl.
CPC ..... *H04R 23/00* (2013.01); *H04R 1/04* (2013.01); *H04R 3/00* (2013.01); *H04R 3/06* (2013.01);
(Continued)

(58) Field of Classification Search
CPC ... H04R 1/04; H04R 3/00; H04R 3/06; H04R 17/02; H04R 19/005; H04R 19/04;
(Continued)

(56) References Cited

U.S. PATENT DOCUMENTS 5,051,799 A 9/1991 Paul et al.
9,712,923 B2 * 7/2017 Fürst ..... G06F 1/324
(Continued)

FOREIGN PATENT DOCUMENTS

EP 2007167 A2 12/2008
WO WO 2007009465 A2 1/2007

OTHER PUBLICATIONS

Raychowdhury et al., "A 2.3nJ/Frame Voice Activity Detector Based Audio Front-end for Context-Aware System-On-Chip Applications in 32nm CMOS," *IEEE Custom Integrated Circuits Conference* (*CICC*), San Jose, CA, Sep. 9-12, 2012, pp. 1-4.

*Primary Examiner* — Huyen D Le
(74) *Attorney, Agent, or Firm* — Seed IP Law Group LLP

(57) ABSTRACT

Described herein is a MEMS acoustic transducer device provided with a micromechanical detection structure that detects acoustic-pressure waves and supplies a transduced electrical quantity, and with an integrated circuit operatively coupled to the micromechanical detection structure and having a reading module that generates at output an audio signal as a function of the transduced electrical quantity. The integrated circuit is further provided with a recognition module, which recognizes a of sound activity event associated to the transduced electrical quantity. The MEMS acoustic transducer has an output that supplies at output a data signal that carries information regarding recognition of the sound activity event.

20 Claims, 9 Drawing Sheets

Related U.S. Application Data division of application No. 15/840,501, filed on Dec. 13, 2017, now Pat. No. 10,715,929, which is a division of application No. 14/532,951, filed on Nov. 4, 2014, now Pat. No. 9,866,972.

(51) Int. Cl.

| | |
|---|---|
| ***H04R 3/06*** | (2006.01) |
| ***H04R 1/04*** | (2006.01) |
| ***H04R 3/00*** | (2006.01) |
| ***H04R 19/00*** | (2006.01) |
| *G10L 25/78* | (2013.01) |

(52) U.S. Cl.

CPC ..... *H04R 19/005* (2013.01); *H04R 19/04* (2013.01); *H04R 23/006* (2013.01); *G10L 25/78* (2013.01); *H04R 2201/003* (2013.01)

(58) Field of Classification Search

CPC H04R 23/00; H04R 23/006; H04R 2201/003; H04R 2499/11; G10L 25/78

See application file for complete search history.

(56) References Cited

U.S. PATENT DOCUMENTS

| | | | | |
|---|---|---|---|---|
| 11,172,312 | B2 * | 11/2021 | Fürst | H04R 19/005 |
| 2005/0251386 | A1 | 11/2005 | Kuris | |
| 2006/0034472 | A1 | 2/2006 | Bazarjani et al. | |
| 2007/0281761 | A1 | 12/2007 | Kim | |
| 2009/0180628 | A1 | 7/2009 | Stephanson | |
| 2010/0158279 | A1 | 6/2010 | Conti et al. | |
| 2013/0339028 | A1 | 12/2013 | Rosner et al. | |
| 2015/0043755 | A1 | 2/2015 | Furst et al. | |
| 2015/0350774 | A1 | 12/2015 | Furst et al. | |
| 2020/0336841 | A1 * | 10/2020 | Zeleznik | H04R 3/00 |

* cited by examiner

MICRO-ELECTRO-MECHANICAL ACOUSTIC TRANSDUCER DEVICE WITH IMPROVED DETECTION FEATURES AND CORRESPONDING ELECTRONIC APPARATUS

BACKGROUND

Technical Field

The present disclosure relates to a MEMS (micro-electro-mechanical systems) acoustic transducer device having improved detection features and to a corresponding electronic apparatus.

Description of the Related Art

The increasing use is known, for example in portable electronic apparatuses, such as tablets, smartphones, digital audio players, photo- or video cameras and consoles for videogames, of acoustic transducers (microphones) including micromechanical detection structures made, at least in part, of semiconductor materials and using MEMS technology.

A MEMS acoustic transducer generally comprises: a micromechanical detection structure, designed to transduce the mechanical quantity to be detected (in particular, acoustic-pressure waves) into an electrical quantity (for example, a capacitive variation, in the case of capacitive detection structures); and an electronic reading circuit, usually integrated as an ASIC (Application-Specific Integrated Circuit), designed to carry out suitable processing operations (amongst which operations of amplification and filtering) of the transduced electrical quantity for supplying an electrical output signal, whether analog (for example, a voltage) or digital (for example, a PDM—Pulse-Density Modulation—signal). This electrical signal is then made available for an external electronic apparatus (the so-called "host") incorporating the acoustic transducer; for example, it is received at input by a microprocessor control unit of the electronic apparatus.

The micromechanical detection structure of a MEMS acoustic transducer of a capacitive type generally comprises a mobile electrode, obtained as a diaphragm or membrane, set facing a substantially fixed electrode. The mobile electrode is generally anchored, by a perimetral portion thereof, to a substrate, whereas a central portion thereof is free to move or deflect in response to acoustic-pressure waves incident on a surface thereof. The mobile electrode and the fixed electrode provide the plates of a detection capacitor and bending of the membrane that constitutes the mobile electrode causes a variation of capacitance of the detection capacitor.

A MEMS acoustic transducer of a known type is, for example, described in U.S. Patent Publication No. US 2010/0158279 A1, filed in the name of the present Applicant.

MEMS acoustic transducers have advantageous characteristics, amongst which extremely compact dimensions, reduced consumption levels and a good electrical performance and may be used, for example, for providing UIs (user interfaces) for portable electronic apparatuses, in particular for providing the possibility of imparting voice commands (via sounds or speech).

In this regard, known solutions envisage the use of an acoustic transducer for detecting audio signals and a software module executed within the microprocessor control unit of the host electronic apparatus, for execution of algorithms dedicated to voice recognition (activity known as "VAD—Voice-Activity Detection" or "speech-activity detection" or simply "speech detection", or again as "ASR— Automatic Speech Recognition") and activation of corresponding features within the user interface.

These solutions have, however, some problems, which do not enable full exploitation of the advantageous characteristics thereof.

In particular, due to requirements of energy consumption, which are particularly stringent in the case of portable electronic apparatuses, typically the voice-recognition module is required to be de-activated at the end of a given detection period, or set in an energy-saving or low-power mode.

Consequently, the voice-recognition features may not be operative all the time and typically require pressing of a key (or execution of a similar operation) by the user for their re-activation, i.e., for starting analysis of the sound activity and waking up the voice-recognition module.

Further, the voice-recognition module constitutes only one of the various operating modules that are managed by the microprocessor control unit of the electronic apparatus that houses the acoustic transducer. Consequently, voice recognition may at times be executed with a certain delay, for example in the case where the control circuit itself is occupied with other features and in any case execution of the voice-recognition module may prevent execution of other important operations by the microprocessor control unit and in any case constitutes an additional computational load for the same control unit.

BRIEF SUMMARY

One embodiment of the present disclosure is directed to a MEMS acoustic transducer device that includes a micromechanical detection structure configured to detect acoustic-pressure waves and supply a transduced electrical quantity and an integrated circuit coupled to the micromechanical detection structure. The integrated circuit includes a reading module configured to generate at output an audio signal as a function of the transduced electrical quantity and a recognition module configured to recognize a sound activity event associated with the transduced electrical quantity.

BRIEF DESCRIPTION OF THE SEVERAL VIEWS OF THE DRAWINGS

For a better understanding of the present disclosure, preferred embodiments thereof are now described, purely by way of non-limiting example and with reference to the attached drawings, wherein.

DETAILED DESCRIPTION

Figure 1:
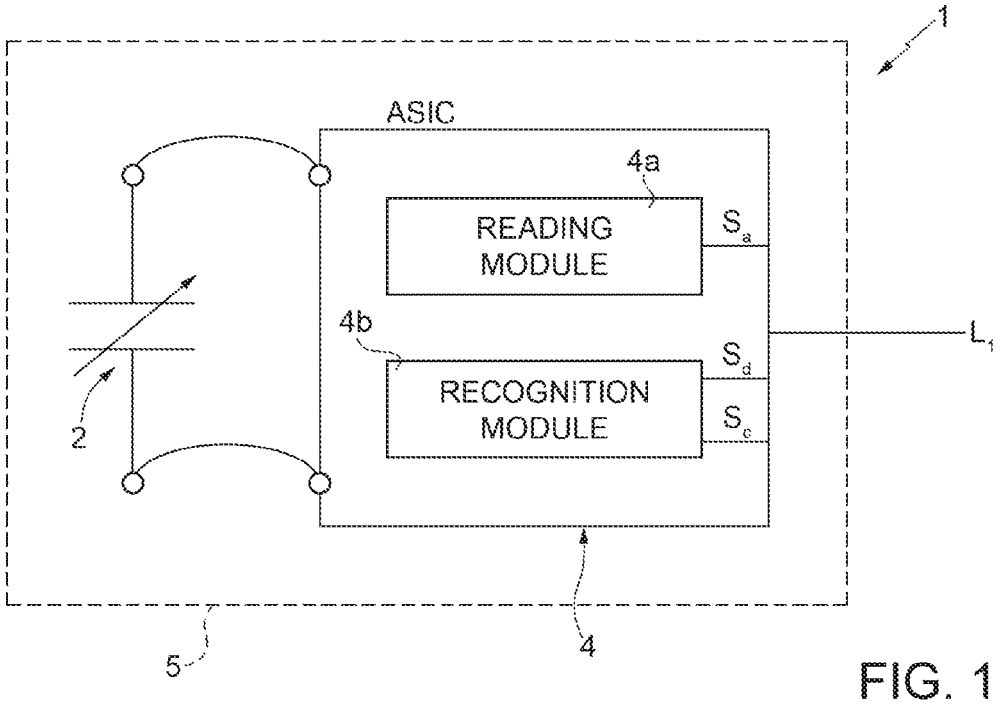
FIGS. 1-3 show block diagrams of respective variants of a MEMS acoustic transducer, according to the present solution.

With reference to FIG. 1, a MEMS acoustic transducer device is now described, designated as a whole by 1, according to the present solution.

The acoustic transducer device 1 comprises a micromechanical detection structure 2, of a known type (not described in detail herein), for example of a capacitive type (and for this reason represented as a capacitor with variable capacitance in FIG. 1 and in the following figures) and an integrated electronic circuit 4 (referred to in what follows as "ASIC 4"), electrically and operatively coupled to the micromechanical detection structure 2.

The acoustic transducer device 1 further comprises a package 5, which encloses the micromechanical detection structure 2 and ASIC 4, constituting the mechanical and electrical interface thereof with respect to the external environment, for example enabling entry of acoustic-pressure waves for enabling detection by the micromechanical detection structure 2, and the electrical connection of the ASIC 4 towards the outside world.

The micromechanical detection structure 2 transduces the acoustic-pressure waves coming from the external environment into an electrical quantity (in particular, a capacitive variation).

The ASIC 4 comprises a reading module 4*a*, which receives at input the transduced electrical quantity and processes it (for example, carrying out amplification and filtering operations), for generating and supplying an electrical output signal, in particular an audio signal $S_a$, indicative of the acoustic-pressure waves detected by the micromechanical detection structure 2.

As will be described in greater detail hereinafter, the reading module 4*a* comprises: a transducer stage, for example including a pre-amplifier (in the case of an analog implementation), which receives the electrical quantity and supplies a transduced electrical signal; possible appropriate stages for further processing; and an output stage, for example, including a biasing stage (in the case of analog implementation) or an analog-to-digital converter stage (in the case of digital implementation).

The electrical output signal is analog (for example, a voltage), or digital (for example, a PDM—Pulse-Density Modulated—signal), according to whether the ASIC 4 is of an analog type or includes digital components (for example, a microprocessor logic unit, a microcontroller, an FPGA—Field-Programmable Gate Array, a DSP—Digital Signal Processor).

According to an aspect of the present solution, the ASIC 4 further comprises a recognition module 4*b*, provided in addition to the reading module 4*a* and co-operating therewith.

In particular, the recognition module 4*b* is configured for evaluating, in an autonomous and automatic way, the sound activity associated to the electrical quantity transduced by the micromechanical detection structure 2 and thus associated to the state, or level, of sound activity of the external environment, in order to recognize the occurrence of at least one preset sound event, for example the presence of a sound having a preset level of intensity or of the speech of a user.

The recognition module 4*b* supplies at output a data signal $S_d$, which carries the information regarding recognition of the sound event, for example the speech of the user.

According to a further aspect of the present solution, the recognition module 4*b* has an input that receives a control signal $S_c$, on the basis of which it is possible to configure parameters of recognition of the sound activity (for example, the characteristics of the preset sound event, such as the speech of the user or the sound to be recognized).

In a possible embodiment, illustrated in FIG. 1, the acoustic transducer device 1 has a single line for connection and interface with the outside world, designated by $L_1$, on which the audio signal $S_a$ and the data signal $S_d$ are supplied at output, in a suitable manner (as will be described in detail hereinafter in a possible implementation) and on which the control signal $S_c$ is further received at input.

Figure 2:
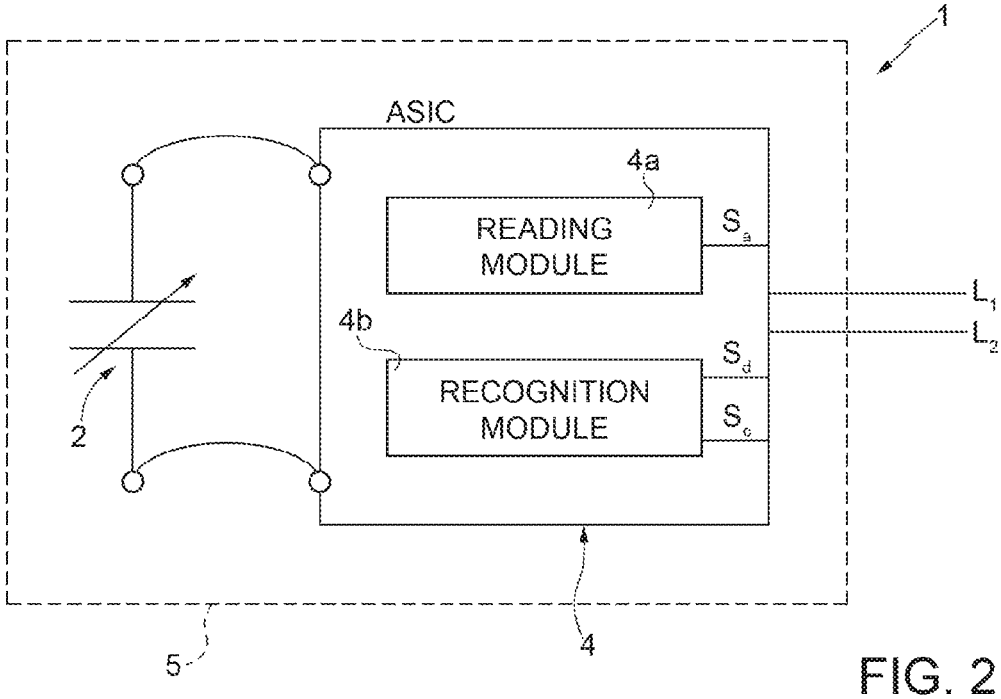

In a different embodiment, illustrated in FIG. 2, the acoustic transducer device 1 has a first line and a second connection line for connection with the outside world, designated by $L_1$ and $L_2$, on which the audio signal $S_a$ and the data signal $S_d$ are supplied at output, in an appropriate way (as will be described in detail hereinafter in a possible implementation) and the control signal $S_c$ is further received at input: for example, the audio signal $S_a$ is supplied at output on the first connection line $L_1$ and the data signal $S_d$ is supplied at output on the second connection line $L_2$; or else, both the audio signal $S_a$ and the data signal $S_d$ are supplied at output together on the first connection line $L_1$, whereas the control signal $S_c$ is received at input through the second connection line $L_2$ (which is in this case present); or else again, the audio signal $S_a$ is supplied at output on the first connection line $L_1$, whereas the control signal $S_c$ is received at input and the data signal $S_d$ is supplied at output through the second connection line $L_2$.

Figure 3:
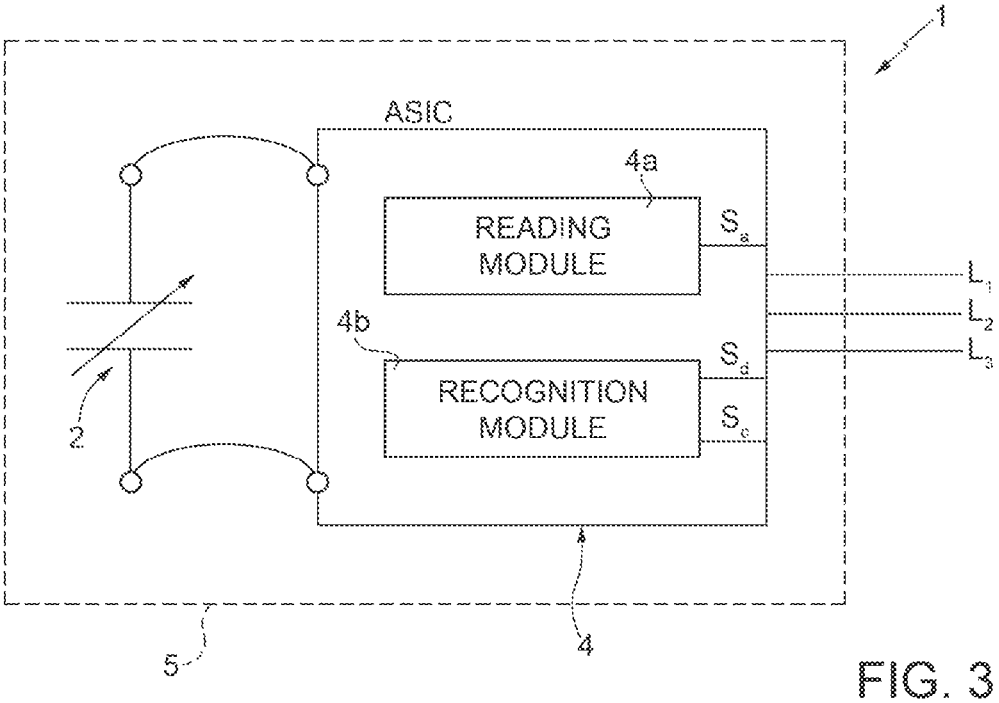

In yet a different embodiment, illustrated in FIG. 3, the acoustic transducer device 1 has a first line, a second line and a third connection line for connection with the outside world, designated by $L_1$, $L_2$ and $L_3$, on which the audio signal $S_a$ and the data signal $S_d$ are respectively supplied at output, in an independent way, and the control signal $S_c$ is received at input.

Figure 4:
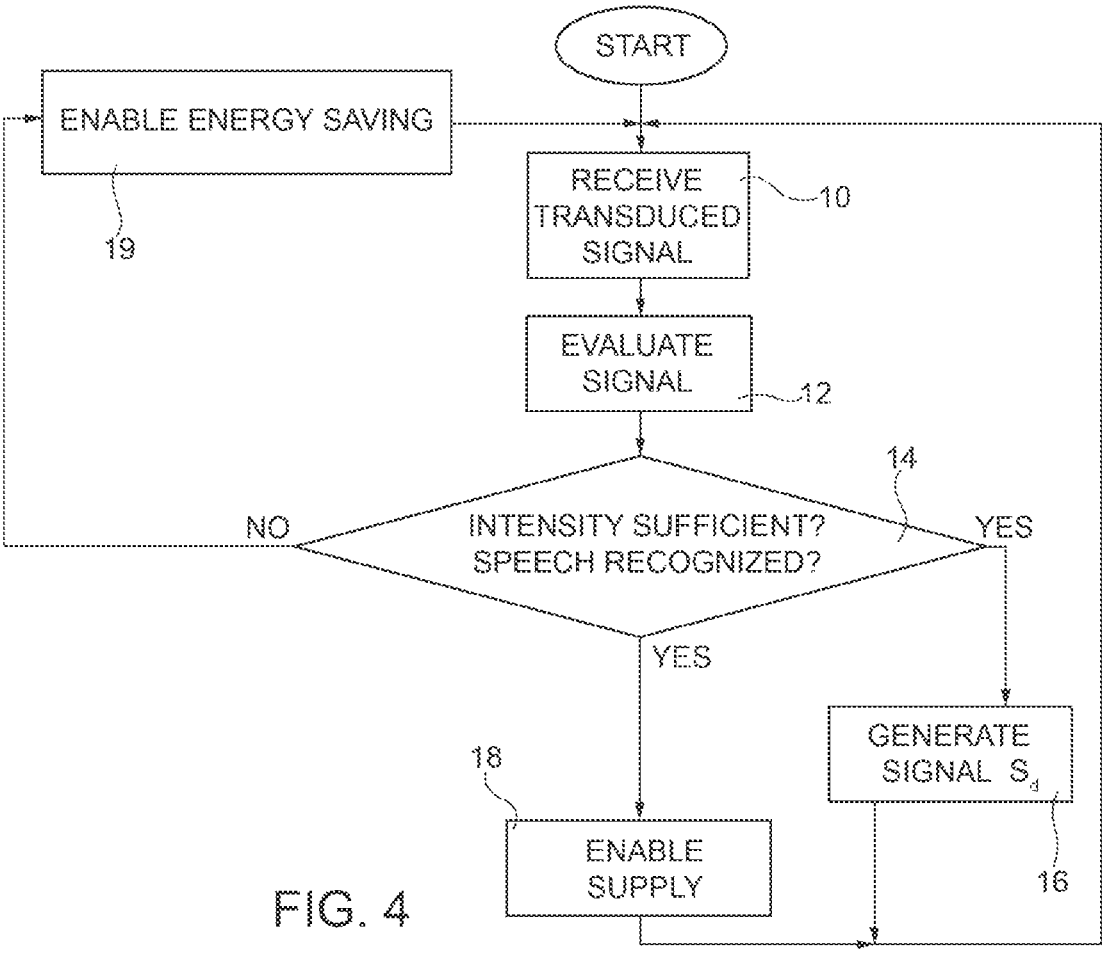
FIG. 4 is a flowchart regarding operations carried out in the MEMS acoustic transducer of FIGS. 1-3.

Irrespective of the particular embodiment chosen from among the ones listed previously, the recognition module 4*b* carries out the operations that are now described with reference to FIG. 4.

In a first step, designated by 10, the recognition module 4*b* receives the transduced electrical signal (whether analog or digital), appropriately pre-processed, from the reading module 4*a*.

Then (step 12), the recognition module 4*b* carries out suitable evaluation operations on the transduced electrical signal, for example for evaluating the level and intensity of the signal (and thus of the sound detected).

The intensity of the signal may, for example, be evaluated in terms of the RMS (Root Mean Square) value, the peak value, or particular statistics, for example regarding the number of zero crossings. Alternatively, more complex algorithms may be executed, for example, for recognition of the speech of the user (such as VAD algorithms).

In this regard, a VAD algorithm may envisage the following operations: an operation of noise reduction, for example by a spectral subtraction in the transduced electrical signal;

an operation of calculation of characteristics or quantities of the transduced electrical signal, or of a portion thereof; and a classification stage, which applies appropriate rules to the characteristics/quantities calculated, for determining the possible presence of speech.

Next (step 14), the recognition module 4*b* verifies whether the intensity (or other characteristics) of the transduced electrical signal satisfies a given relation with one or more preset values (for example, it is higher than a threshold) and/or whether the speech of the user has been recognized.

If the above verification step yields a positive result (step 16), the recognition module 4*b* suitably generates the data signal $S_d$ for associating thereto the information on the fact that the preset sound activity (for example, the speech of the user) has been recognized. As will be described in detail hereinafter, in this step 16, the recognition module 14*b* may alternatively, or in addition in the case of digital implementation, set to a preset value (for example the high value) the data signal $S_d$, which may in this case represent an interrupt signal such as to indicate immediately to the outside world, for example to the microprocessor control unit of the host electronic apparatus, the fact that the sound event has been recognized.

According to an aspect of the present solution, once again in the case where it is verified that the intensity of the transduced electrical signal satisfies the given relation with the preset value and/or the speech of the user is recognized, the recognition module 4*b* is further configured to enable (step 18), a complete electrical supply and/or a complete operation of the reading module 4*a*, in such a way that the same reading module 4*a*, in addition to continuing to execute the operations of transduction of the quantity detected, will generate at output the audio signal $S_a$.

Otherwise (step 19), according to a further aspect of the present solution, the recognition module 4*b* may disable supply of at least part of the reading module 4*a* or at least part of the features of the same reading module 4*a*, in such a way that the acoustic transducer device 1 enters a condition of energy saving or low-power mode. For example, the operations of further processing of the transduced electrical signal for generation at output of the audio signal $S_a$ may be disabled, or else detection in a part of the audio band (not relevant for the recognition activity described above) may be disabled.

In any case, from the aforesaid steps 16, 18, 19, the operations return to step 10, for reception of the transduced electrical signal. It should be noted, in fact, that the recognition module 4*b* operates continuously in time for detecting the desired sound activity in a timely manner.

Figure 5:
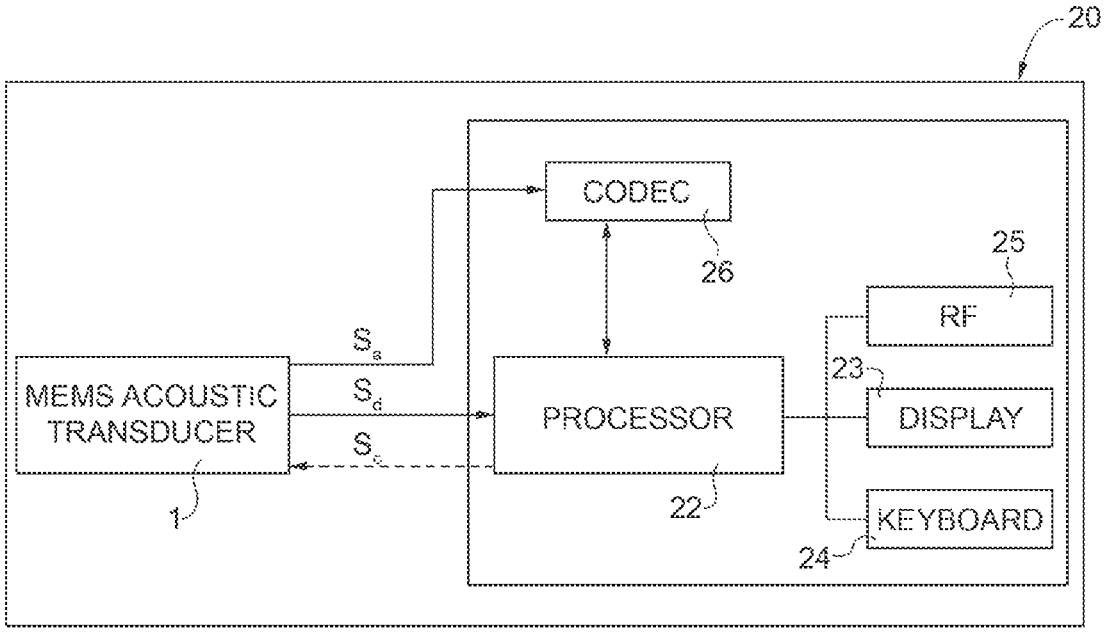
FIGS. 5-6 show respective block diagrams of variants of an electronic apparatus that incorporates the MEMS acoustic transducer.

FIG. 5 is a schematic illustration of an electronic apparatus 20, which incorporates the acoustic transducer device 1 (not shown in detail herein).

The electronic apparatus 20 is, for example, a portable electronic apparatus, such as a tablet, a smartphone, a cellphone, a laptop, a photo camera or a video camera, a device for video-surveillance (or the like) and comprises a processor control module 22, which manages general operation thereof.

The electronic apparatus 20 further comprises, a display 23, data-input elements 24 (for example, a keyboard or a touch screen), a radiofrequency module 25, with respective antenna and an audio encoding module 26 (the so-called "codec").

The processor control module 22 is operatively coupled to the acoustic transducer device 1 for receiving the audio signal $S_a$ (via the audio encoding module 26) and in particular the data signal $S_d$ indicative of the state of the detected sound activity.

The audio signal $S_a$ may be used for imparting voice commands in a user interface that is managed by the processor control module 22. Advantageously, the data signal $S_d$ may be used for reactivating, or waking up, the processor control module 22 and/or the user interface (operating, as an example, as an unlocking feature for the display 23, instead of a manual input on the keyboard or on the touch screen).

If the data signal $S_d$ is an interrupt signal, waking-up or re-activation is extremely fast and does not require any further processing operation by the processor control module 22, consequently reducing the computational load thereof.

The processor control module 22 may thus operate in an energy-saving or low-power mode (or in stand-by mode) and be appropriately activated, or woken up, by the data signal $S_d$, which is directly supplied by the acoustic transducer device 1 following upon processing operations executed autonomously and in an independent way.

The acoustic transducer device 1 is, in fact, at least in part, active continuously in time in order to evaluate the state of the sound activity of the surrounding environment, operating in the so-called "sniff mode".

Advantageously, as highlighted previously, the acoustic transducer device 1 is further able to reconfigure itself, as regards energy consumption, assuming an energy-saving mode (with reduced detection features, for example in terms of the acoustic band detected or in terms of the generation of the audio signal $S_a$ at output) in the case where the sound activity detected so requires (for example, in so far as the intensity of the transduced electrical signal is lower than a given threshold, or no speech of the user is detected). Instead, the acoustic transducer device 1 assumes a normal operating mode, with higher energy consumption and with complete detection operation (for example, as regards the acoustic band of the signal detected and generation of the audio signal $S_a$), when the sound activity detected indicates the presence of a specific speech of the user or of specific audio events of some other nature.

As indicated previously, in an equally advantageous way, the operating parameters of the recognition module 4*b* of the acoustic transducer device 1 are further totally configurable from the outside (for example, by the processor control module 22) for reconfiguring, even during operation of the electronic apparatus 20, the characteristics of the sound activity to be recognized.

Figure 6:
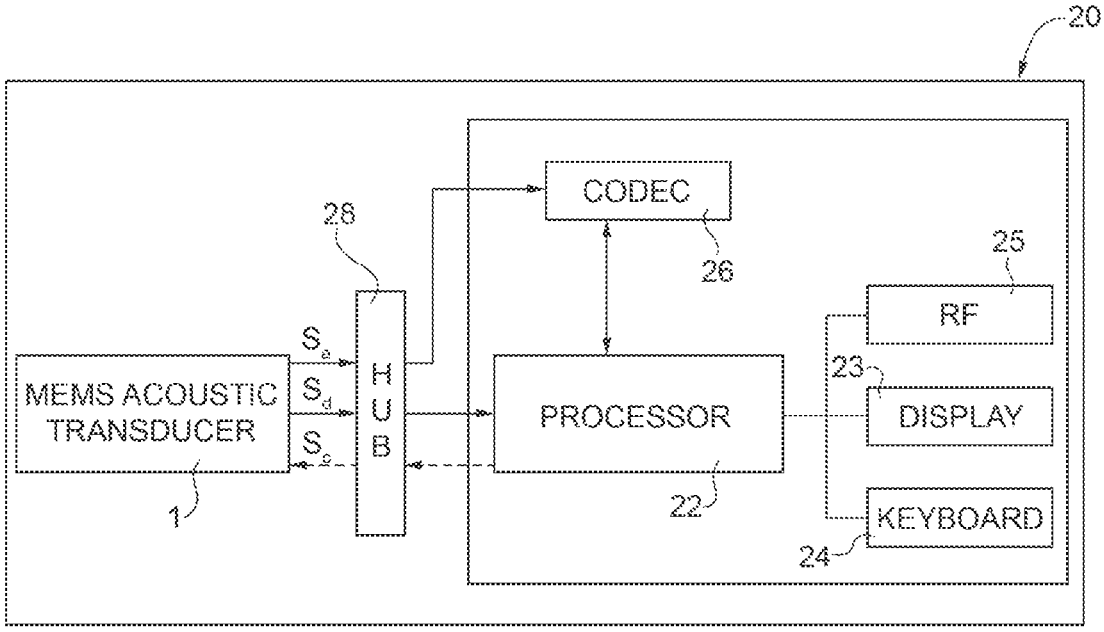

FIG. 6 shows schematically a further embodiment of the electronic apparatus, once again designated by 20, which differs from the one described with reference to FIG. 5, in that it further includes a data-concentrator module 28, the so-called "sensor hub", set between the acoustic transducer device 1 and the processor control module 22 of the electronic apparatus 20.

The data-concentrator module 28, typically including a microcontroller (or a similar processing unit, for example implemented by an FPGA—Field-Programmable Logic Array), has the task of acquiring the detection signals from the acoustic transducer device 1 and possibly from further sensors incorporated in the electronic apparatus 20 (such as an accelerometer, a gyroscope, or a pressure sensor, not illustrated herein), typically coupled to a single digital communication bus and of supplying them to the processor control module 22, possibly after having subjected them to appropriate processing operations.

As a whole, the presence of the data-concentrator module 28 relieves the microprocessor control module 22 of the task of monitoring the outputs of the plurality of sensors, by providing a single acquisition interface and further of the computational burden linked to at least part of the signal-processing operations.

In the specific case, the data-concentrator module 28 receives from the acoustic transducer device 1 the audio signal $S_a$ and the data signal $S_d$, and then supplies it to the processor control module 22 (either directly or via the audio encoding module 26). Further, the data-concentrator module 28 receives the control signal $S_c$ from the processor control module 22 and supplies it to the acoustic transducer device 1.

A more detailed description of possible embodiments of the acoustic transducer device 1 now follows, in particular as regards the recognition module 4*b* and the corresponding lines for connection and interfacing towards the outside world ($L_1$, and possibly $L_2$ and $L_3$).

As a whole, it is emphasized that these connection lines for connection towards the outside world may be advantageously obtained exploiting the same pads (or pins) for connection towards the outside world, with which acoustic transducers of a known type are provided, thus not requiring any modification as regards the layout of the electrical connections with the host electronic apparatus (the so-called "footprint").

Figure 7:
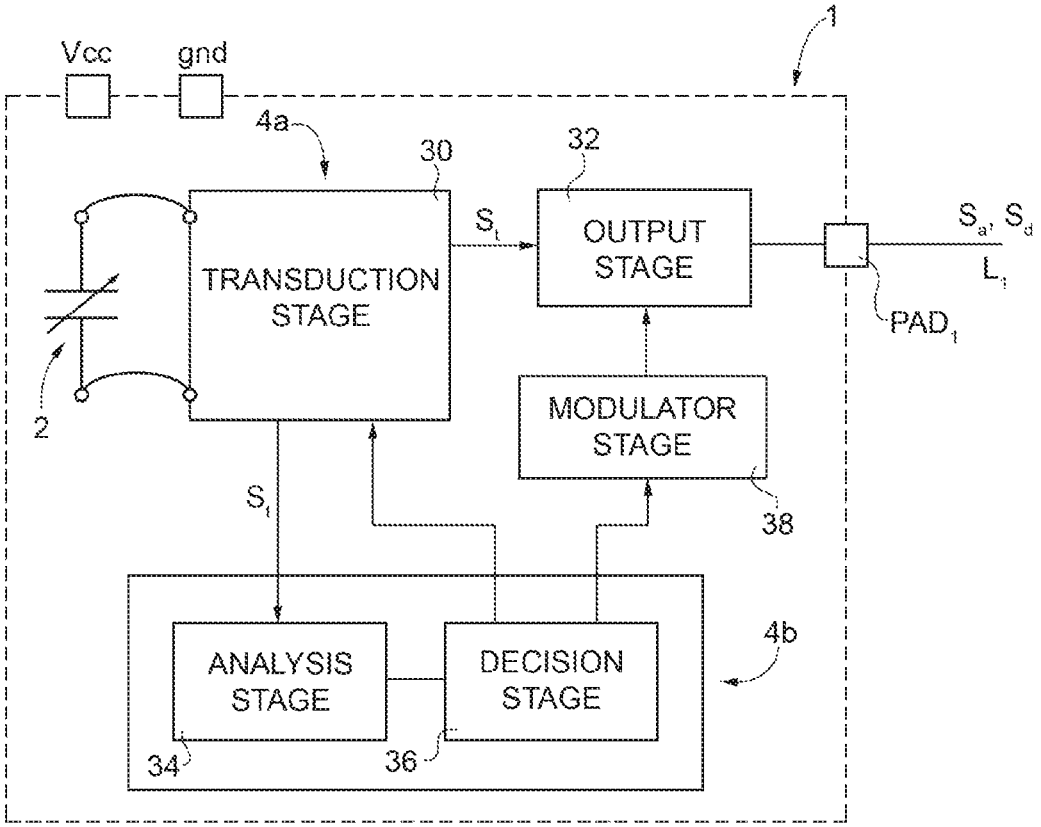
FIG. 7 shows a more detailed block diagram of one embodiment of a MEMS acoustic transducer.

In particular, FIG. 7 shows a possible embodiment, of an analog type, in which just the first connection line $L_1$ is provided, associated jointly to both the audio signal $S_a$ and the data signal $S_d$.

The reading module 4*a* comprises a transducer stage 30, for example including a pre-amplifier, which receives the electrical quantity (for example, the capacitive variation) from the micromechanical detection structure 2 and supplies a transduced electrical signal $S_t$ and, in the embodiment illustrated, an output stage 32, which receives the transduced electrical signal $S_t$ and generates (for example, by appropriate power components) the audio signal $S_a$, which is supplied on a connection pad $Pad_1$, coupled to the first connection line $L_1$.

The recognition module 4*b* comprises: an analysis stage 34, which receives the transduced electrical signal $S_t$ and carries out appropriate estimations and evaluations of parameters and characteristics of the same signal in order to evaluate the level of the sound activity detected (as described previously) and to supply analysis information; and a decision stage 36, coupled to the analysis stage 34 and designed for carrying out appropriate actions according to the analysis information supplied by the analysis stage 34 on the basis of the estimates and evaluations performed.

In particular, the decision stage 36 controls, according to the analysis information, a modulator stage 38, operatively coupled to the output stage 32, for supplying the data signal $S_d$, in this case together with the audio signal $S_a$ on the first connection line $L_1$.

Figure 8A:
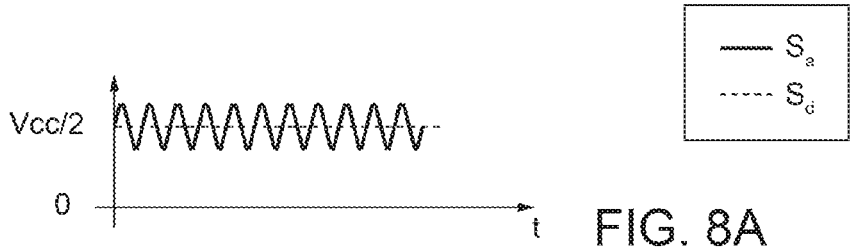
FIGS. 8*a*-8*c* show plots of electrical quantities regarding the MEMS acoustic transducer of FIG. 7.
Figure 8B:
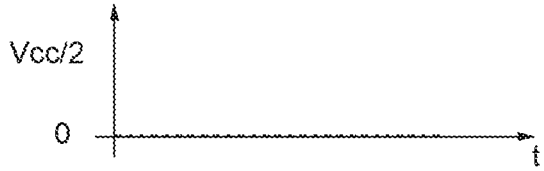

In particular, according to a possible embodiment, the decision stage 36 controls the modulator stage 38 in such a way that the audio signal $S_a$ will present an offset equal to $V_{cc}/2$ (where $V_{cc}$ is the supply voltage of the acoustic transducer device 1), as shown in FIG. 8*a*, in the case where a preset detected sound activity is recognized, and for supplying a zero signal in the case where the preset sound activity is not recognized (FIG. 8*b*).

In this way, it is easy for the processor control module 22 of the electronic apparatus 20, for example by filtering the DC component, to reconstruct the data signal $S_d$ and obtain the information on the state of sound activity.

Figure 8C:
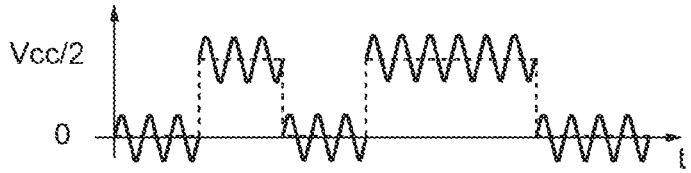

Alternatively, as shown in FIG. 8*c*, the audio signal $S_a$ may be modulated by the data signal $S_d$ in a more complex way, for example for transmitting also the information corresponding to the RMS value of the sound activity recognized, in addition to the information of presence/absence of the same sound activity. In the case illustrated in FIG. 8*c*, the data signal $S_d$ is a square-wave signal, with a value of the duty cycle that is a function of the information that is to be transmitted.

Further, the decision stage 36 is configured to control the reading module 4*a* for activating an energy-saving state, in the absence of sound activity recognized, for example by switching off the output stage 32 and in this way disabling generation of the audio signal $S_a$ at output.

Figure 9:
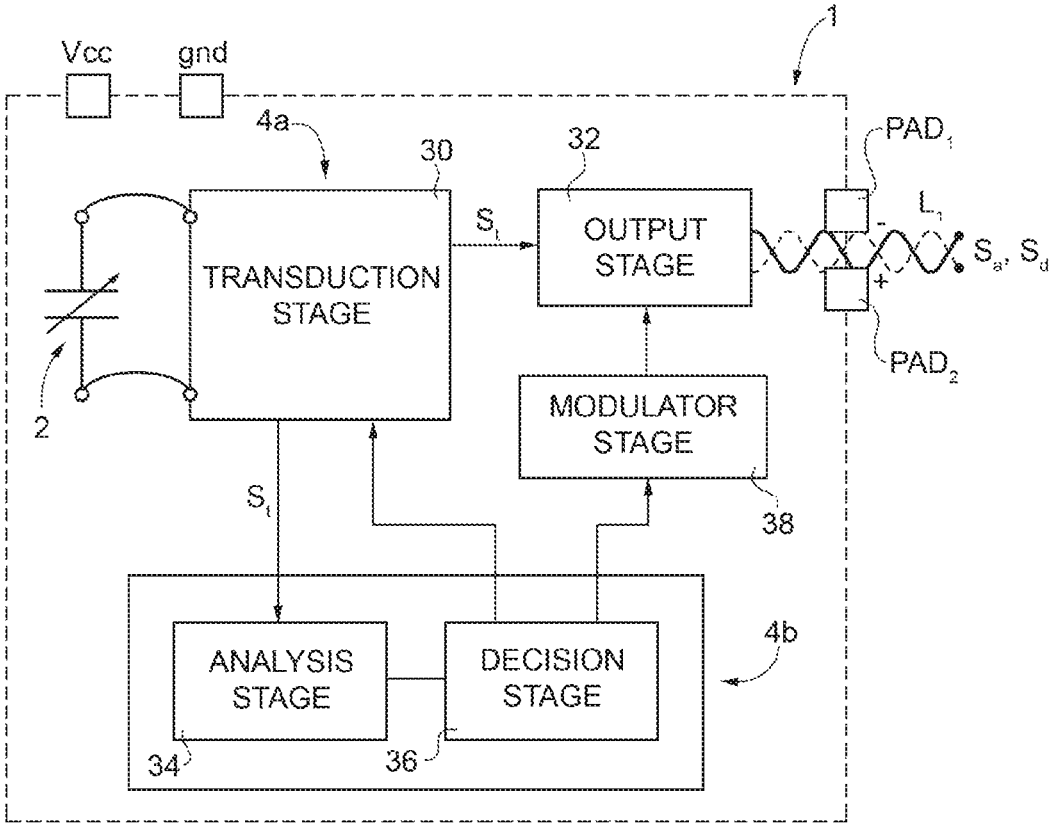
FIG. 9 shows a more detailed block diagram of a further embodiment of a MEMS acoustic transducer.

FIG. 9 shows a different embodiment of the acoustic transducer device 1, which also in this case is of an analog type.

This embodiment differs from the embodiment described with reference to FIG. 7 in that it supplies the audio signal $S_a$ and jointly the data signal $S_d$, on a differential output, i.e., between the connection pad $Pad_1$ and a further connection pad $Pad_2$, both of which are coupled to the same first connection line $L_1$.

Figure 10A:
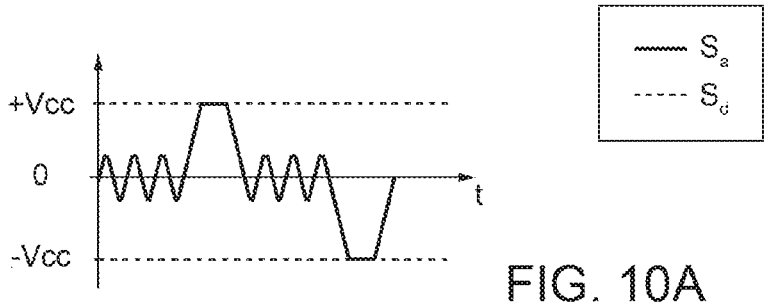
FIGS. 10*a*-10*b* show plots of electrical quantities regarding the MEMS acoustic transducer of FIG. 9.

In this case, the decision stage 36 controls the modulator stage 38 for supplying on the first connection line $L_1$ a differential signal in the presence of sound activity and a signal saturated at $+V_{cc}$ or $-V_{cc}$ in the absence of sound activity, as shown in FIG. 10*a*.

Figure 10B:
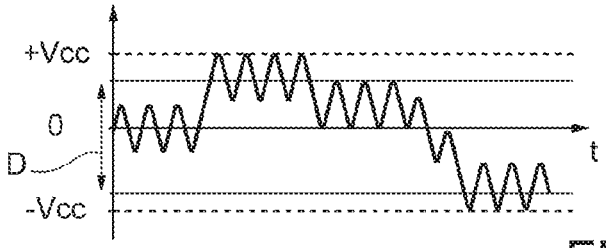

Alternatively, as shown in FIG. 10*b*, the decision stage 36 may control the modulator stage 38 for supplying further information via the modulated output signal, for example the RMS value of the sound activity detected, in any case respecting the dynamics of maximum voltage allowed (in this case comprised between $-V_{cc}$ and $+V_{cc}$, designated by D and indicated by the arrow) without clipping the audio signal $S_a$.

Also in this embodiment, the data signal $S_d$ is supplied jointly with the audio signal $S_a$ on the same connection line $L_1$.

Figure 11:
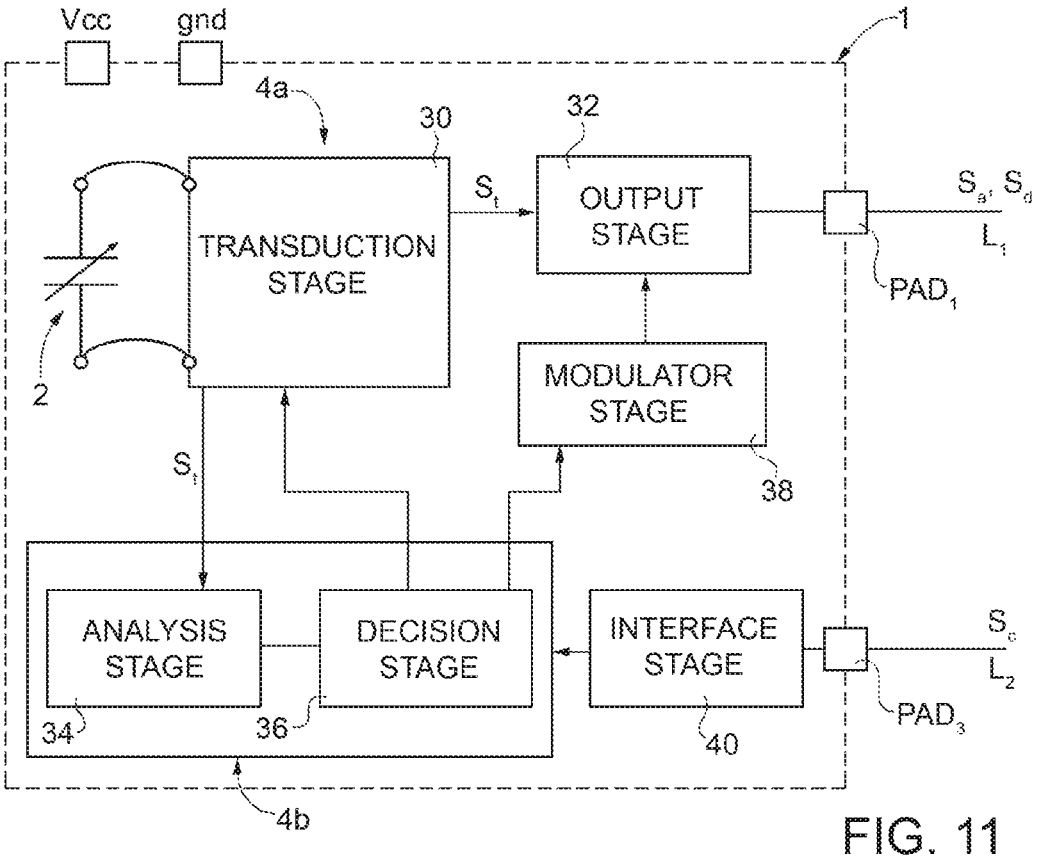
FIGS. 11-16 show respective block diagrams of yet further embodiments of a MEMS acoustic transducer.

FIG. 11 shows a further embodiment, of an analog type, in which the first connection line $L_1$ is once again provided for joint transmission of both the audio signal $S_a$ and the data signal $S_d$, as described with reference to FIG. 7, and a second connection line $L_2$ is further provided for the control signal $S_c$, which is received by the acoustic transducer device 1 for adjustment of the parameters and of the characteristics of the sound activity to be recognized by the analysis stage 34.

In this case, the acoustic transducer device 1 has a connection pad $Pad_3$, designed to receive the control signal $S_c$ and further an interface stage 40, coupled at input to the connection pad $Pad_3$ and at output to the recognition module 4*b*.

In a first variant, the control signal $S_c$ is a voltage signal, having a variable value as a function of the desired adjustment of the recognition parameters, and the interface stage 40 is a reference-voltage reading stage, designed to receive the control signal $S_c$ and to read the voltage value thereof. The reference voltage may, for example, be used for adjusting the value of a threshold voltage to be used for recognition of the sound activity.

Figure 12:
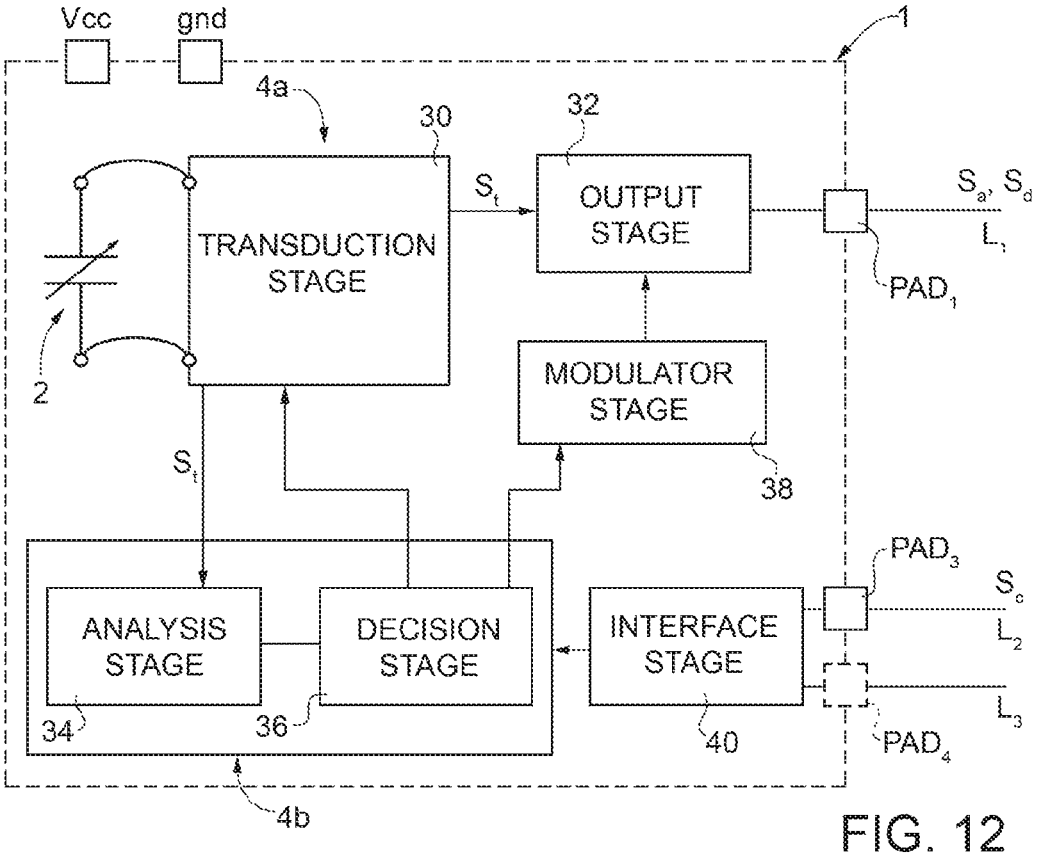

A further variant, shown in FIG. 12, envisages that the acoustic transducer device 1 is provided with an interface stage 40, of a serial type, for example of an $I^2C$ type. In this case, the control signal $S_c$ is a serial data signal and the connection pad $Pad_3$ coincides with the data input SDA of the $I^2C$ protocol. A further connection pad $Pad_4$ is further provided, associated to a third connection line $L_3$, here coinciding with the clock line SCL of the $I^2C$ protocol.

This variant thus applies in the case of MEMS acoustic transducers 1 of a hybrid type, i.e., of an analog type, but provided with serial communication interface. It is in any case evident that any serial communication interface that differs from the $I^2C$ protocol could likewise be used, for example a protocol of the SPI type, UART type, or the like.

Figure 13:
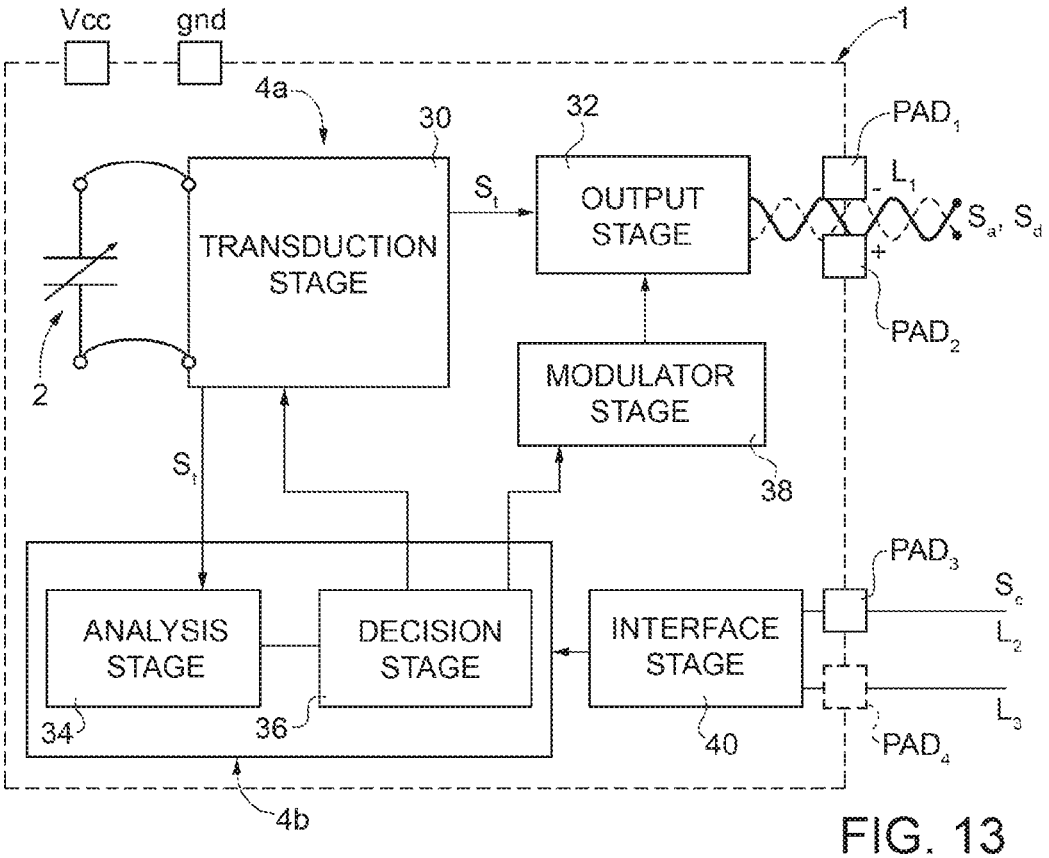

As illustrated in FIG. 13, similar considerations apply as regards the embodiment discussed with reference to FIG. 9, with differential output for the audio signal $S_a$ (FIG. 13 shows in particular the variant regarding the acoustic transducer device 1 of a hybrid type).

Figure 14:
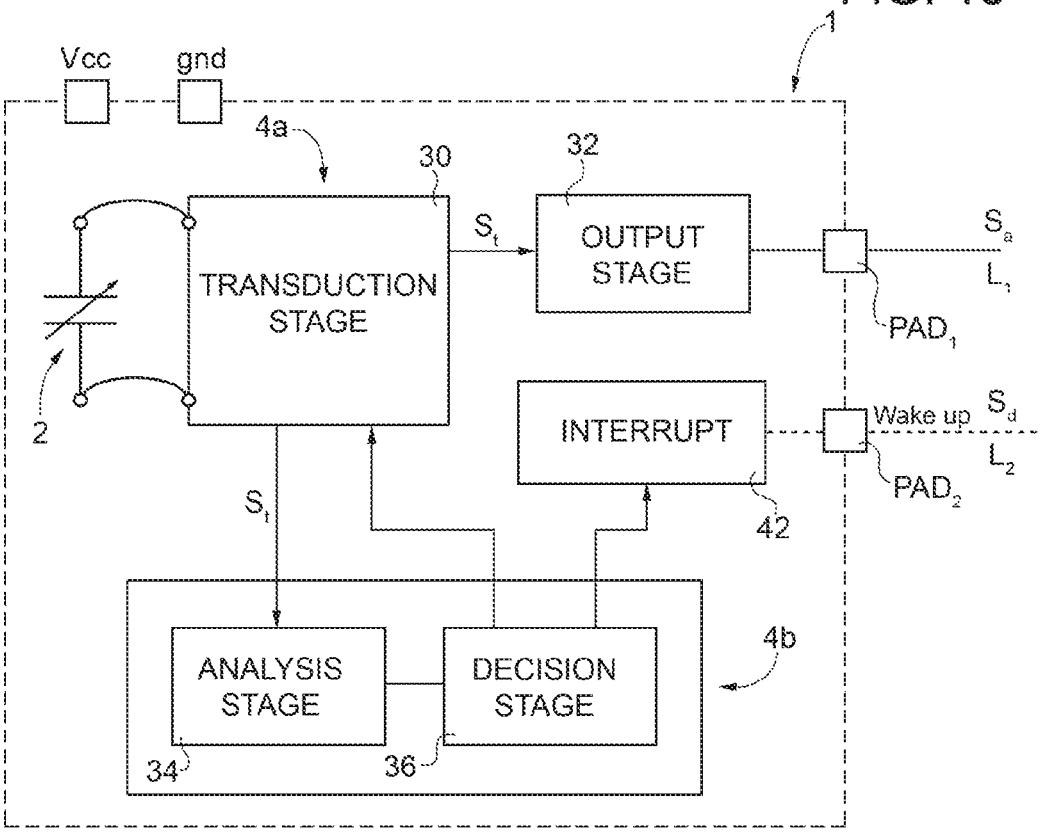

FIG. 14 illustrates yet a different embodiment, which envisages the use of two distinct connection lines for transmission of the audio and data signals $S_a$, $S_d$.

In this case, the data signal $S_d$ is an interrupt signal, i.e., a digital signal having two possible values, high and low, which is generated by an interrupt stage 42, controlled by the decision stage 36, once again on the basis of the recognition information.

In particular, the interrupt signal may assume a high value, upon recognition of a desired sound activity and a low value, otherwise. The interrupt stage 42 may, for example, include a FET driver.

The audio signal $S_a$ is once again supplied at output on the first connection line $L_1$, at the connection pad $Pad_1$.

Advantageously, the data signal $S_d$ (in this case, constituted by the interrupt signal) is supplied at output on the second connection line $L_2$, at the connection pad $Pad_2$, being directly available for the processor control circuit 22 of the electronic apparatus 20 that houses the acoustic transducer device 1.

Altogether similar considerations apply to the embodiment with differential audio output discussed with reference to FIG. 9.

Figure 15:
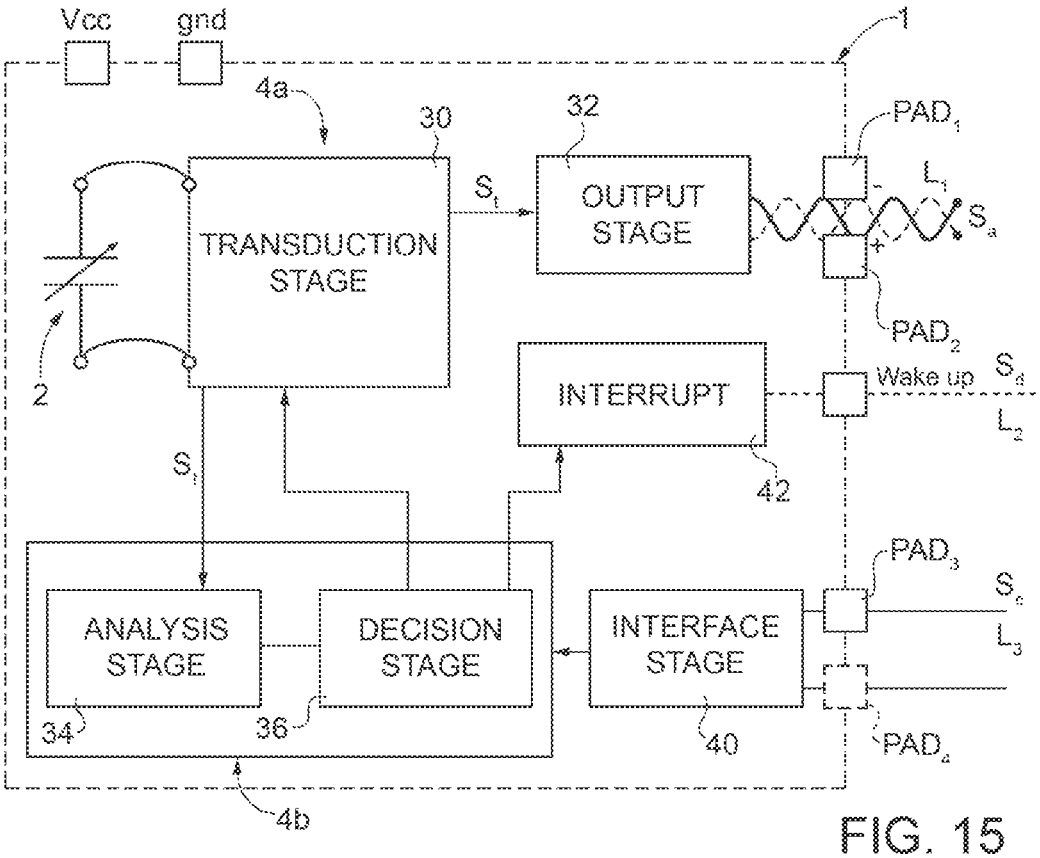

In this regard, for example, FIG. 15 illustrates a further embodiment, in which the control signal $S_c$ received on the third connection line $L_3$ is also present.

Figure 16:
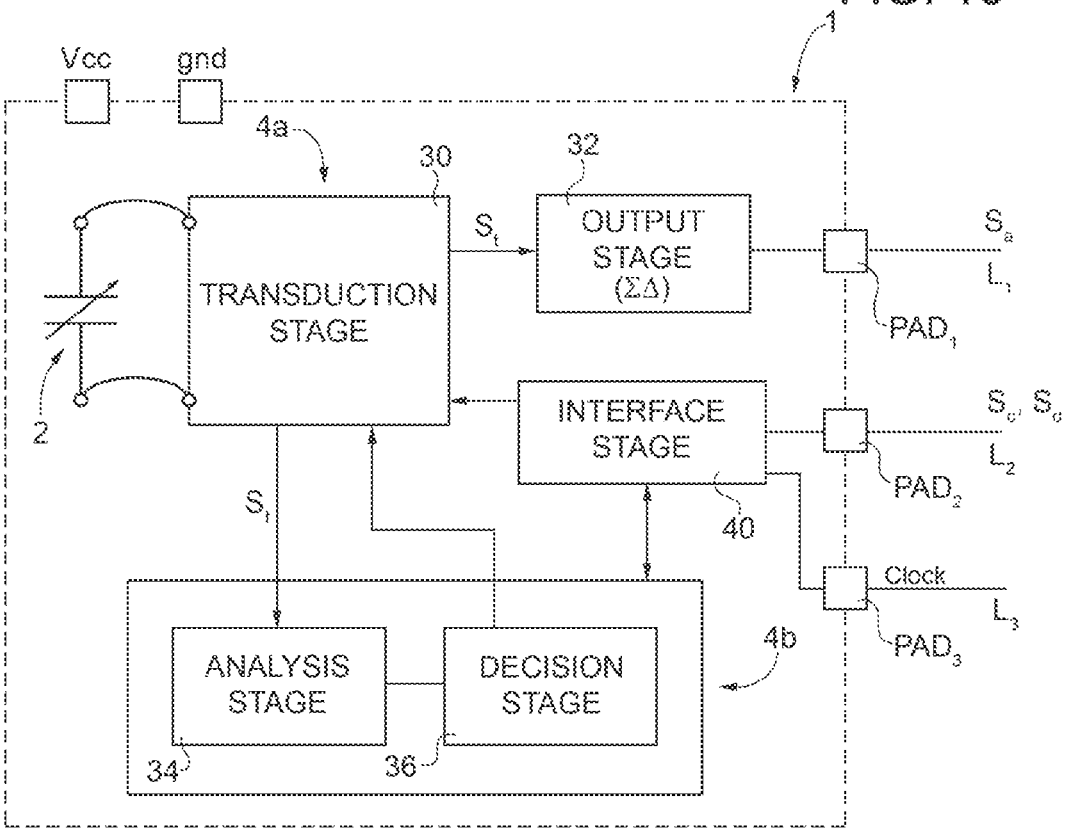

With reference to FIG. 16, an embodiment regarding an acoustic transducer device 1 of a digital type is now described.

The transducer stage 30 comprises in this case, as the output stage 32, an analog-to-digital converter, in particular a sigma-delta modulator, which receives the transduced electrical signal $S_t$ and generates the audio signal $S_a$, in this case of a digital type, which is supplied on the first connection line $L_1$, at the connection pad $Pad_1$.

The serial-interface stage, once again designated by 40, of the acoustic transducer device 1, in the example of an $I^2C$ type, is here used both for supplying the data signal $S_d$ and for receiving the control signal $S_c$.

In particular, the decision stage 36 generates the interrupt signal, as data signal $S_d$, on the second connection line $L_2$ coinciding with the data line associated to the $I^2C$ serial interface.

On the same data line, the recognition module **4*b* of the acoustic transducer device 1 may receive the control signal $S_c$, of a digital type, containing the control and configuration information for the analysis stage 34**.

In this regard, it may be noted that the control signal $S_c$ and the data signal $S_d$ may be present on the second connection line $L_2$ at separate and distinct times. For example, the control signal $S_c$ may be received in a first time interval, during which configuration of the recognition module **4*b* is, for example, carried out and then, in a second time interval subsequent to the first time interval, the data signal $S_d$, which is the result of the processing operations carried out by the recognition module 4*b***, may be supplied.

Via the clock line, SCL, of the $I^2C$ serial protocol a same clock signal for being used by the interface stage 40 and the reading module **4*a* of the acoustic transducer device 1** may be received, in the case where the operating frequency allows it (for example in the case where the frequency is lower than 10 kHz).

Also in this case, transmission at output of the data signal $S_d$ and possible reception at input of the control signal $S_c$ are implemented using the pin present in traditional MEMS acoustic transducers of a digital type, thus not requiring modifications in the layout of the electrical connections towards the outside world, in particular towards the processor control circuit 22 of the electronic apparatus 20 that houses the acoustic transducer device 1.

On the basis of the recognition information resulting from the analysis of the transduced signal $S_t$ made by the analysis stage 34, the decision stage 36 may also in this case modify the operating state of the reading module **4*a*, for example for activating an energy-saving state in the absence of significant sound activity, for example by disabling the output stage 32**.

Figure 17A:
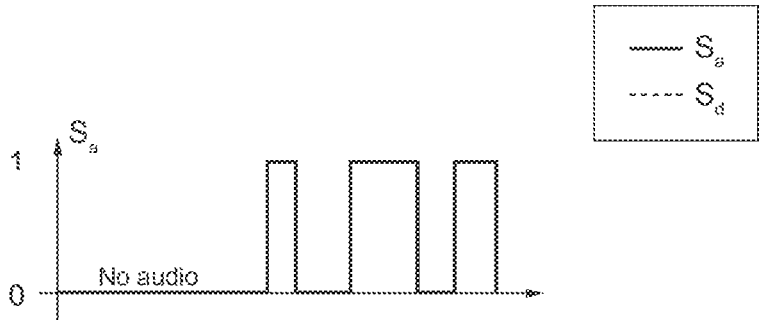
FIGS. 17*a*-17*b* show plots of electrical quantities regarding the MEMS acoustic transducer of FIG. 16.
Figure 17B:
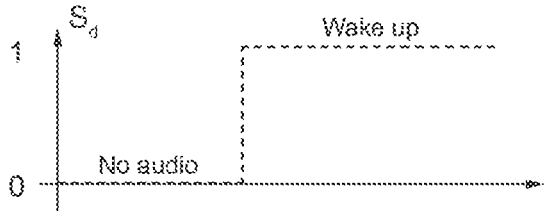

FIG. **17*a* shows a possible plot of the audio signal $S_a$ generated by the acoustic transducer device 1, in which the absence of signal in the case of absence of sound activity may be noted (due to switching-off of the output stage 32); whereas FIG. 17*b* shows the data signal $S_d$, in this case an interrupt signal, which assumes a high value upon recognition of a significant sound activity by the recognition module 4*a* of the acoustic transducer device 1**.

Even though they are not described herein, it is evident that, also in the case of the acoustic transducer device 1 of a digital type, the variants discussed previously as regards transmission or reception of the audio, data and control signals $S_a$, $S_d$, $S_c$ on one or more connection lines, in a joint or distinct way, may be envisaged.

The advantages of the solution described are evident from the foregoing discussion.

In particular, it is once again emphasized that this solution provides a number of advantageous characteristics, amongst which the following may be cited:

- autonomous detection, by the acoustic transducer device 1, of the state, or level, of the sound activity, for example for voice or speech recognition, in combination with a user interface of an electronic apparatus;
- the possibility of reconfiguring the parameters with which the acoustic transducer device 1 carries out the aforesaid recognition, for example for adjusting the parameters of voice-recognition algorithms (such as VAD algorithms);
- the possibility, on the part of the acoustic transducer device 1, of reconfiguring automatically and autonomously (without any external intervention) in terms of its energy consumption, as a function of the level of sound activity detected, for example for activating an energy-saving mode, or a reduced-performance mode, in the absence of a significant level of sound activity;
- the possibility, on the part of the acoustic transducer device 1, of supplying directly at output to an electronic apparatus 20 the information on the state of the sound activity detected, for example, in the form of an interrupt signal, in this way relieving, for example, the processor control circuit 22 of the electronic apparatus 20 of the tasks of recognition of the sound activity (the control circuit in fact may manage and process the audio signal $S_a$ detected by the acoustic transducer device 1 only in the presence of a sound activity that has already been judged significant by the same acoustic transducer device 1) and allowing the processor control circuit 22 to remain inactive until the preset sound activity is detected;

the possible use, for the features of recognition and of communication with the outside world, of the same electrical connections and pins as those used by traditional acoustic transducers, without consequently requiring significant modifications to existing circuits and electronic apparatuses (for example, in terms of number of pins and footprint), thus ensuring a complete compatibility with electronic apparatuses and with pre-existing production standards.

Finally, it is clear that modifications and variations may be made to what has been described and illustrated herein without thereby departing from the scope of the present disclosure, as defined in the annexed claims.

In particular, it is evident that the embodiments previously described are only provided by way of non-exhaustive example, for example as regards the possible implementations of the connection lines for separate or joint output of the audio signal $S_a$ and of the data signal $S_d$ and for reception of the possible control signal $S_c$.

Furthermore, it is evident that the implementation of the various modules and stages discussed previously in the acoustic transducer device 1 may be alternatively of a hardware or software type, according to the specific requirements and general characteristics of the same acoustic transducer device 1.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method, comprising:

processing an electrical signal with a reading module;

generating a transduced electrical signal with the reading module;

receiving the transduced electrical signal with a recognition module;

evaluating a characteristic of the transduced electrical signal with the recognition module;

determining whether the characteristic of the transduced electrical signal satisfies a given relation with one or more preset values with the recognition module;

generating with the recognition module, when the given relation with the one or more preset values are satisfied by the characteristic of the transduced electrical signal, a data signal associated with a present sound activity having been recognized; and generating an audio signal associated with the present sound activity by enabling the reading module with the recognition module, when the given relation with the one or more preset values are satisfied by the characteristic of the transduced electrical signal.

2. The method of claim 1, further comprising enabling with the recognition module, when the one or more preset values are not satisfied by the characteristic of the transduced electrical signal, a low power mode of the reading module.

3. The method of claim 1, wherein enabling with the recognition module the low power mode of the reading module includes limiting a supply of power provided to the reading module.

4. The method of claim 1, further comprising enabling with the recognition module, when the one or more preset values are not satisfied by the characteristic of the transduced electrical signal, a low power mode of a processor configured to receive the data signal and the audio signal.

5. The method of claim 1, wherein the characteristic of the transduced electrical signal is an intensity of the transduced electrical signal.

6. The method of claim 1, wherein verifying the characteristic of the transduced electrical signal satisfies the given relation with one or more preset values with the recognition module further includes verifying the characteristic of the transduced electrical signal is greater than the one or more preset values.

7. The method of claim 1, wherein generating the audio signal associated with the present sound activity by enabling the reading module with the recognition module, when the one or more preset values are satisfied by the characteristic of the transduced electrical signal, further includes transmitting the transduced electrical signal to the reading module.

8. The method of claim 7, wherein transmitting the transduced electrical signal to the reading module further includes:

transmitting the transduced electrical signal to an analysis stage of the reading module;

determining estimations and evaluations of characteristic of the transduced electrical signal to evaluate the present sound activity; and transmitting the estimations and evaluations to a decision stage of the reading module.

9. The method of claim 8, further comprising analyzing the estimations and evaluations with the decision stage of the reading module and controlling a modulator stage coupled to the decision stage of the reading module.

10. A method, comprising:

detecting a present sound activity with a microelectromechanical acoustic transducer;

transmitting a signal from the microelectromechanical system (MEMS) acoustic transducer to a reading module of an integrated electronic circuit;

generating a transduced electrical signal with the reading module;

receiving the transduced electrical signal with a recognition module of the integrated electronic circuit;

determining whether the characteristic of the transduced electrical signal satisfies a given relation with one or more preset values with the recognition module; and generating with the recognition module, when the characteristic of the transduced electrical signal satisfies the given relation with the one or more preset values, a data signal associated with a present sound activity having been recognized;

generating an audio signal associated with the present sound activity by enabling the reading module with the recognition module, when the given relation with the one or more preset values is satisfied by the characteristic of the transduced electrical signal;

enabling with the recognition module, when the characteristic of the transduced electrical signal does not satisfy the given relation with the one or more preset values, a low power mode of the MEMS acoustic transducer.

11. The method of claim 10, further comprising:

transmitting the audio signal to an audio encoding module; and transmitting the data signal to a processor.

12. The method of claim 10, further comprising:

generating a control signal with a processor and transmitting the control signal to the MEMS acoustic transducer by enabling the processor with the recognition module, when the given relation with the one or more preset values is satisfied by the characteristic of the transduced electrical signal.

13. The method of claim 12, wherein enabling with the recognition module operation of the processor further includes controlling one or more modules in electrical communication with the processor.

14. The method of claim 13, wherein the one or more modules including at least one of a radiofrequency module, a display, and a data-input element.

15. The method of claim 12, wherein transmitting the control signal to the MEMS acoustic transducer includes transmitting the control signal to the recognition module.

16. The method of claim 10, further comprising enabling with the recognition module, when the characteristic of the transduced electrical signal does not satisfy the given relation with the one or more preset values, a low power mode of a processor.

17. The method of claim 10, further comprising:

transmitting the audio signal to a data concentrator module in electrical communication with an audio encoding module and a processor; and transmitting the data signal to the data concentrator module.

18. A method, comprising:

receiving a transduced electrical signal with a recognition module in an electronic device;

evaluating a characteristic of the transduced electrical signal with the recognition module;

comparing the characteristic of the transduced electrical signal to one or more preset values with the recognition module;

generating, when the characteristic of the transduced electrical signal satisfies a given relation with the one or more preset values, a data signal with the recognition module and generating an audio signal with a reading module in the electronic device by enabling operation of the reading module;

enabling with the recognition module, when the characteristic of the transduced electrical signal does not satisfy the given relation with the one or more preset values, a low power mode of the electronic device.

19. The method of claim 18, further comprising:

processing an electrical signal with the reading module; and generating the transduced electrical signal with the reading module to be received by recognition module.

20. The method of claim 18, wherein enabling with the recognition module the low power mode of the electronic device includes enabling with the recognition module a low power mode of the reading module.

* * * * *